US005215700A

United States Patent [19]

Garganese

[11] Patent Number: 5,215,700

[45] Date of Patent: Jun. 1, 1993

[54] METHOD OF MOLDING A DISPLAY CARD

[76] Inventor: Richard S. Garganese, 40 Celestia Ct., North Kingstown, R.I. 02852-1003

[21] Appl. No.: 788,442

[22] Filed: Nov. 6, 1991

Related U.S. Application Data

[60] Division of Ser. No. 637,710, Jan. 7, 1991, abandoned, which is a continuation of Ser. No. 516,974, Apr. 30, 1990, abandoned.

[51] Int. Cl.[5] ..... B29C 45/16

[52] U.S. Cl. ..... 264/250; 206/486; 264/255; 264/267; 264/328.7

[58] Field of Search ..... 206/477, 486, 488, 495, 206/566; 211/13, 60.1; 264/255, 250, 262, 273, 328.7, 274, 267

[56] References Cited

U.S. PATENT DOCUMENTS

| | | | |
|---|---|---|---|
| 2,119,832 | 6/1938 | Schless | 206/486 |
| 3,277,562 | 10/1966 | Huguenin | 264/273 |
| 3,865,249 | 2/1975 | Herzog | 264/273 |
| 3,890,679 | 6/1975 | Simon | 264/273 |
| 4,099,611 | 7/1978 | Feibelman | 206/566 |
| 4,294,365 | 10/1981 | Henderson | 211/60.1 |
| 4,571,322 | 2/1986 | Eichelberger et al. | 264/273 |
| 4,697,705 | 10/1987 | Gargenese | 206/488 |
| 4,718,554 | 1/1988 | Barbato | 206/477 |
| 4,739,878 | 4/1988 | DiDomenico | 206/566 |
| 4,944,389 | 7/1990 | Robertson | 206/566 |
| 5,125,816 | 6/1992 | Morita | 264/328.7 |

*Primary Examiner*—Jan H. Silbaugh
*Assistant Examiner*—Brian J. Eastley
*Attorney, Agent, or Firm*—Barlow & Barlow, Ltd.

[57] ABSTRACT

A method of molding a display card for jewelry which has a pair of posts protruding from at least the rear face thereof that serve as gripping members for pin formed jewelry articles. The posts have bores that are formed with a wide mouth for ease of insertion and the bore tapers to a small gripping portion to hold the jewelry pin. A decorative layer overlies the central area of the card and is frictionally held in place by the posts.

2 Claims, 2 Drawing Sheets

METHOD OF MOLDING A DISPLAY CARD

This application is a division of application Ser. No. 07/637,710, filed Jan. 7, 1991 now abandoned, which is a continuation of application Ser. No. 07/516,974 filed Apr. 30, 1990, also abandoned.

This invention relates to a display card for jewelry items and more particularly, for displaying earrings. It has long been the practice in the industry to utilize display cards that can hang from some support for displaying pierced earrings. For example, the display cards that have been used in the past consist of a substantially flat card that has a pair of apertures therethrough, through which one would assemble by hand the posts of earrings and retain the earring on the card by placing the clutch on the post after it has been assembled, the clutch, therefore, lying against the rear side of the card and gripping the earring thereto. This forms a rather attractive means of displaying earrings and the like in retail establishments.

The difficulty with this system of display lies in the fact that it has become a manual operation to assemble earrings onto display cards. This means that there is a labor cost involved which is significant. In my prior patent, U.S. Pat. No. 4,697,705, it was proposed to provide a display card for jewelry which eliminated the need for placing the clutches on the posts of the earrings after they were placed on the card by using a card having encapsulated resilient material and by storing the clutches in a separate compartment. It has been found, however, that this is not a cost effective card and it is desirable to find a construction which embodies some of the features of my prior invention and yet is sufficiently inexpensive to produce so as to compete with existing earring display cards.

SUMMARY OF THE INVENTION

The invention provides a display card which overcomes the price disadvantage above noted. The card has integrally formed posts that protrude from the front and/or rear face of the card, which posts have wide mouths and tapering bores which will accept the pin stem on an article of jewelry such as an earring. The wide mouth provides ease of entry of a post without precise alignment and further, lends itself to automated assembly operations as well as faster assembly operations for those that utilize hand labor. To display hoop earrings, the posts have bores that pass thereacross into which the pin stems of the hoops may be inserted. The card, as in my prior patent, provides a packaging compartment for the clutches, and in one embodiment has slots in a wall of the compartment so that a purchases will be advised of the contents. Further, the use of a compartment with at least one opening, permits the clutches to be packaged automatically.

DESCRIPTION OF THE PREFERRED EMBODIMENTS

Figure 1:
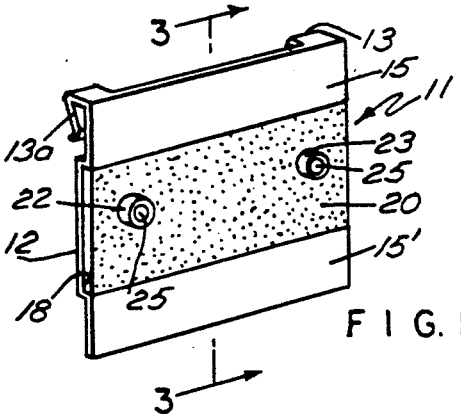
FIG. 1 is a perspective view of one form of a jewelry display card made in accordance with the invention.
Figure 2:
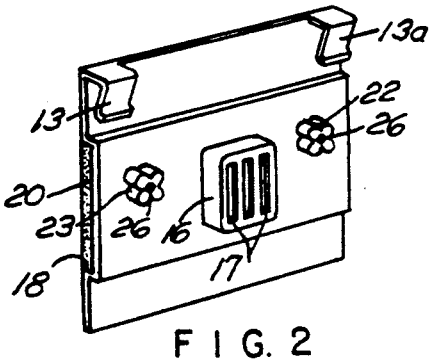
FIG. 2 is a rear view thereof.
Figure 3:
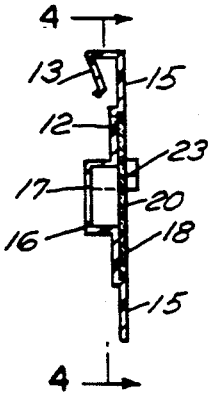
FIG. 3 is a sectional view taken on lines 3—3 of FIG. 1.
Figure 4:
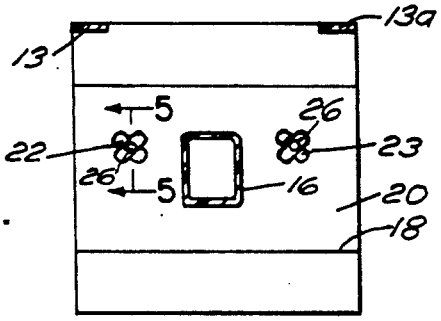
FIG. 4 is a sectional view taken on lines 4—4 of FIG. 3.

Referring now more particularly to the drawings and particularly to FIG. 1, there is illustrated a display card generally indicated 11 that comprises a main platelike body portion 12 and has a pair of top hanger portions 13, 13*a* that are formed integrally with the main body. As seen in FIG. 3, the platelike body portion 12 has a substantially central compartment 16 which is open to at the front face of the display card, which front face may be recessed as at 18 and which recess or face may be covered by a decorative flocked pad 20 or in some cases the pad may be plastic flock coated with a viewable window to see into the compartment. When the flocked pad is received in a recess such as 18, the depth will be approximately the thickness of the pad so that the resulting structure presents a smooth surface. Further the frontal face is provided with clear areas 15, 15' that allow indicia to be hot stamped thereon.

Figure 5A:
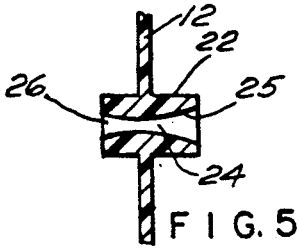
FIG. 5A is a view similar to FIG. 5 of another form.
Figure 5:
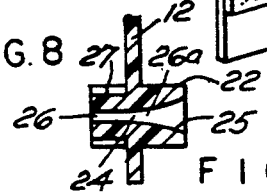
FIG. 5 is a sectional view taken on lines 5—5 of FIG. 4.
Figure 11:
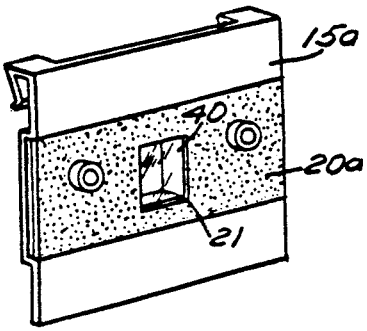
FIGS. 11–14 are perspective and detached edge views of an alternate form employing transparent window to the clutch compartment.
Figure 12:
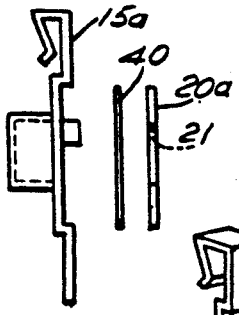

The display card has integrally molded therein postlike members 22, 23. The post members are formed with an internal bore 24 (see FIG. 5) in which there is a wide open mouth portion 25 that tapers gradually to a restricted portion 26 that will be of a size slightly smaller than a pin stem of an earring which stems range in size between 0.026"–0.031". In an effort to accept a wide diameter of posts from 0.0265" to 0.0315", the structure seen in FIG. 5 is used. In this configuration the i.d. of the bore is 0.022" and the walls are thinned in at least three or four axial peripheral areas as at 27 to permit deflection of the walls and in this fashion, all post sizes to and including 0.031" may be accommodated as the small wall of the bore can be easily deformed. In serving the normal ear post constructions the structure seen in FIG. 5A may be used and in this arrangement, the narrow portion 26 can be 0.001" or 0.0015" under the selected size so that gripping of the post will occur.

As will be noted, the body portion 12 is formed with a depression 18. Into the depression 18 a fabric layer or flocked pad member 20 is received which is punched with apertures so as to tightly grip the posts 22, 23. In this fashion, the flocked pad may lie in the depression without the necessity of utilizing adhesive. In some cases, however, it will be necessary to insure retention, and adhesive will be used. In the embodiment illustrated in FIGS. 1–4, the flocked pad 20 is secured to the face of the card so as to cover the open top of the compartment. It will be understood that the decorative fabric layer or pad 20 may be formed from flocked material that is applied preferably onto sheet plastic or a variety of other materials. After purchase, it will be easy for a customer to lift the flocked area and gain access to the clutches that are retained in the compartment 16. It will be noted that the compartment 16 is provided with window slots 17 so that a purchaser will be apprised of the fact that the compartment contains the clutches for the earrings mounted on the face of the card.

Figure 7:
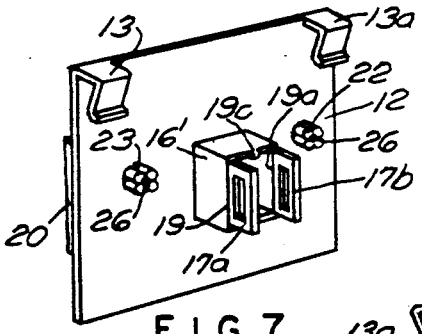
FIG. 7 is a rear perspective view of the form of FIG. 6.
Figure 6:
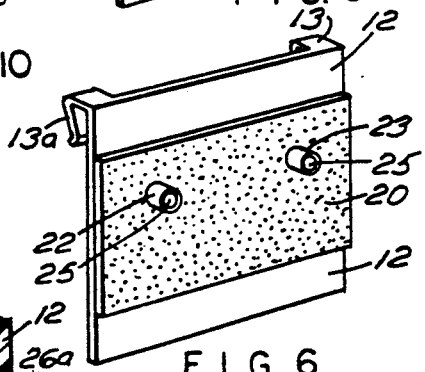
FIG. 6 is a perspective view of another alternate form of jewelry display card without the depressed face portion.

In FIG. 6 there is illustrated a card that has a flat face which in all respects has the same posts as in the previous illustrations. In FIG. 7, there is illustrated a slight modification in which the central compartment, designated 16', is provided with a hinged door-like members **17*a*, 17*b* which doors have apertures therein that resemble windows to permit viewing of the contents. In this particular embodiment, it is intended that the container 16' be molded such as that it provides a thinning or hinge area as at 19, 19*a* and the intent in this embodiment is to enable one to load the display card with the clutches from the rear face thereof, come down with a heated closure member that will fold down the hinge flap 17*a*, 17*b* and provide an essentially tight closure for the clutches by essentially reforming the material. To this end, of course, the display card should be preferably made by a suitable, resiliently deformable plastic material. Alternately, the flaps or doors 17*a*, 17*b* will have window slots therein to view the contents and view the contents and should be molded in thin cross section and a deformable protrusion placed on the edge of the compartment as at 19*c***. The flaps may then be retained by the protrusion in a closed position.

Figure 8:
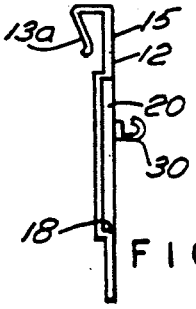
FIG. 8 is a central sectional view showing a molded hook for holding articles on the display card such as a hoop earring.

Referring to FIG. 8, there is illustrated an adaptation of the invention to displaying other articles of jewelry that are not pin stem earrings but are adapted to be retained by a hook-like member 30 that is molded integral with the card. For example, there are popular today hoop earrings that can be received and displayed with this hook accessory eliminating the need for wire ties and excessive labor.

Figure 10:
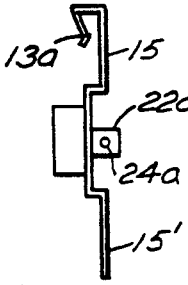
FIG. 10 is an edge view of the form shown in FIG. 9.
Figure 9:
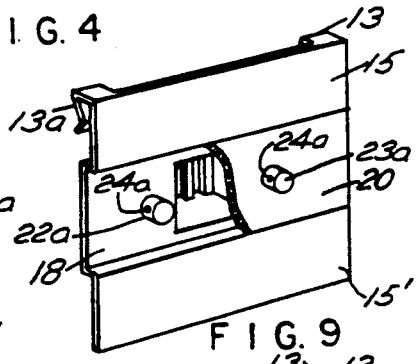
FIG. 9 is a perspective view of another form of card for side post insertion used with hoop earrings.

Referring to FIGS. 9 and 10, there is illustrated a further adaptation of the invention to displaying French wire earrings. To this end the card is essentially molded in a similar fashion to the FIG. 1–4 embodiment and the posts **22*a*, 23*a* are provided with transverse bores 24*a*** that will grip the wire of the earring.

Figure 13:
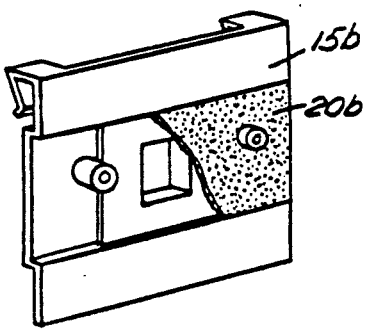
Figure 14:
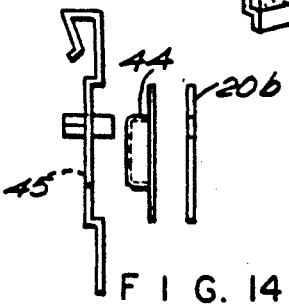

In FIGS. 11–14 there is illustrated a variation on the concept of informing the purchaser of the contents in the compartment. To this end the compartment is molded as a depressed portion of the card face **15*a* and the flock overlay 20*a* is provided with an aperture 21 and a transparent or translucent covering 40 can be adhesively attached to the flocked pad or to the card face as necessary. In some cases it may be more convenient to mold a separate container and provide an aperture in the card face 15*b* as illustrated in FIGS. 13 and 14. Here a separate transparent or translucent compartment 44 is secured in aperture 45 and this compartment has an integral covering. The flocked pad 20*b*** in this case may be imperforate as the contents of the compartment may be viewed readily.

Figure 15:
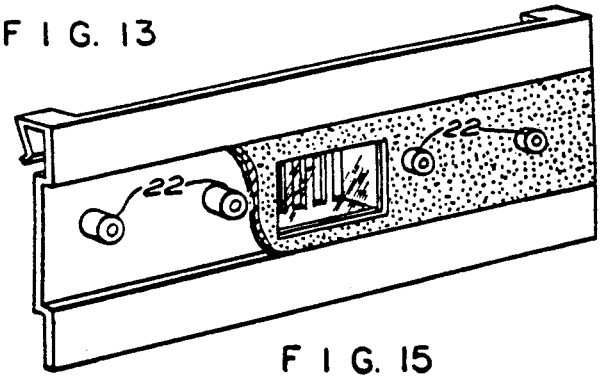
FIG. 15 is a perspective view of a multiple pair card.
Figure 16:
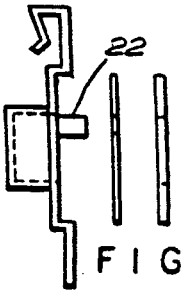
FIG. 16 is a detached edge view thereof.

In FIGS. 15 and 16 there is illustrated a variation of the invention that is adapted to display two pair of earrings. To this end the card is provided with four posts 22 and in all other respects may assume the configuration of any of the preceding embodiments.

Figure 17:
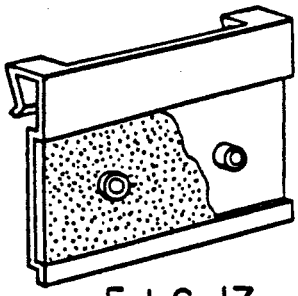
FIGS. 17 and 18 are perspective and detached edge views of a short card.
Figure 18:
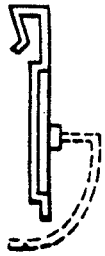

FIGS. 17 and 18 illustrate a shortened card that is particularly useful for displaying certain type of earrings that are configured to be worn by looping under the bottom extent of the ear lobe. Such ear rings are illustrated diagrammatically in FIG. 18.

Figure 19:
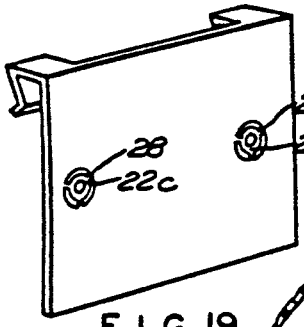
FIG. 19 is a plan view of a card with integral clutches.
Figure 21:
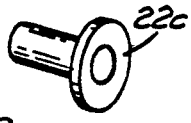
FIG. 21 is a perspective view of a clutch that has been detached from the card of FIG. 19.
Figure 20:
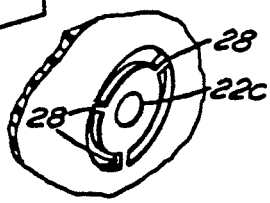
FIG. 20 is an enlarged fragmentary view of the clutch portion of the card of FIG. 19.

FIG. 19 illustrates a version of the card where the clutches for the earrings are integral with the card. The posts **22*c* and 23*c* are held in the face of the card by web sections 28. The posts are formed in the same fashion as the posts illustrated in FIG. 5 and FIG. 5A**. Cards of this design have utility in a low end line of jewelry as the need for metallic or separate clutches is eliminated.

To produce a suitable product the card is injection molded from a thermoplastic material having a hardness of 40 to 50 on the Shore D scale, a tensile strength of 3000 to 4000 p.s.i. and a Young's Modulus of at least 20,000 p.s.i.

Figure 22:
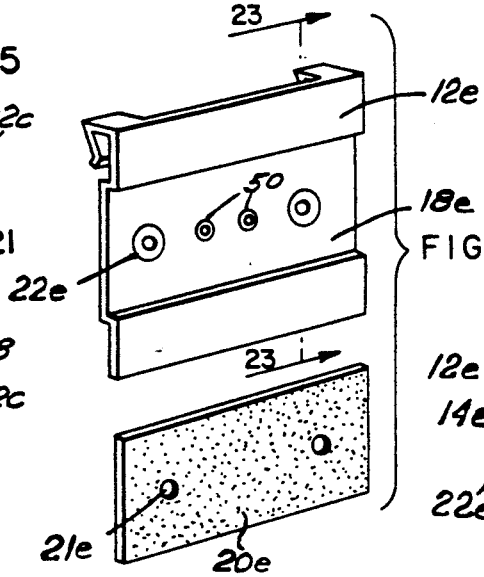
FIG. 22 is a detached perspective view of another form of card with integral clutches.
Figure 23:
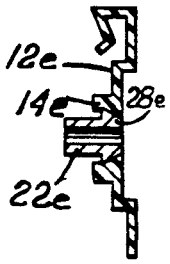
FIG. 23 is a sectional view taken on lines 23—23 of FIG. 22.

Referring now to FIGS. 22 and 23, there is illustrated an adaptation of the invention in which the clutches for the earrings are integral with the card but are formed with a different plastic material. A card of this configuration is molded by utilizing the technology of what is known as mulitcomponent injection molding. Essentially, multicomponent molding employs separate injection points for each material in a sequential process. After the initial portion of the component is molded, as for example here the clutch itself, then the core half of the mold holding the part is rotated to another larger cavity half where a second resin is injected forming the complete card. Alternately, the same can be accomplished by pulling a slide or core after injecting the first material and then filling the resulting void with another resin. A further alternate to using dedicated equipment with two injection points bored onto a stationary platen would be utilizing two conventional injection molding machines wherein one machine molds the initial material, then the partial part is positioned into a second machine by a robot or manually and is molded about. In the instant situation, the clutch would be preferably molded from a co-polyester elastomer which, in some cases, have a range of stiffnesses or by utilizing various ranges of polyvinyl chlorides.

Referring now specifically to the drawings, the card **12*e* is preferably formed with a slight depression or recess 18*e* which may be covered with a flocked pad 20*e* that is provided with a pair of apertures such as 21*e* that will line up with the integrally molded clutch members 22*e*. As seen more particularly in FIG. 23, the clutch members 22*e* which may take the same internal bore configuration as that seen in FIG. 5 or 5*a*, are releasably held in the face of the card 12*e* by forming the clutch with a slight frusto conical head 28*e* and providing the card with lip 14*e* that will tend to hold the clutch in position until it is desired to be dislodged by a simple application of pressure onto the part. It will therefore be apparent that the post forming the clutch member may be used independently and in inexpensive jewelry will amount to a great cost saving. In some cases, it may be practical to also mold guards such as those illustrated in FIG. 22 and designated by the reference numeral 50**, which guards may be also molded of a different material from the main body of the card.

According to the method of assembly of the earrings to the display card of the invention, it would be apparent that the clutches will be placed into the containers 16 or 16', as the case might be, through the opening in the front face of the display card. Next the flocked, decorative portion is affixed over the opening to the container 16 and secured on the front face of the card. In the alternate embodiment of FIG. 7, the front face is planar and the clutches are placed through the rear wall in the container 16' and the doors 17*a*, 17*b*, with slotted window openings, close the compartment 16'. This part of the operation is completely automated. The second major step in the assembly of earrings to the card would be to place the post or wire of the earrings through the bores of the cylindrical posts 22, 23 by inserting the post first into the mouth 25 and then to be gripped by the reduced portion 26. This portion of the operation could be performed by hand or, alternately, by automated machinery.

It is seen, therefore, that the invention herein disclosed provides a highly effective method of assembling earrings onto a display card with a minimum amount of labor and preferably, by an automated assembly process. The pin stems of the earrings are received initially into a funnel like mouth and are releasably secured in the post 22, 23 by being gripped by the narrow portion 26 of the tapering bores therein.

The display card has proved to be very cost effective in use in the jewelry industry. Preliminary time studies have been made where an unskilled person was asked to card earring pairs using the arrangement disclosed herein. This unskilled "carder" was able to card 649 pair in a period of fifty five minutes. Generally accepted industry practice with experienced carding personnel results in between 200 and 225 pair of earrings per hour on cards as disclosed in the Feibelman U.S. Patent No. 4,099,611 where the pin stem of the earring is first inserted through the card and then a clutch is affixed to the portion protruding from the rear face of the card. This represents an improved production rate twice that now experienced in the trade.

I claim:

1. A method of molding a card for jewelry with pin stems comprising the steps of:

providing a multicomponent mold;

molding a card with a face portion in said mold and forming in said card at least one slightly tapered aperture having a lip at one end of said aperture and then subsequently molding of elastomeric plastic a post having a frustoconical head in the at least one aperture to rest on said lip, said lip releasably holding the post in position until it is desired to be dislodged by application of pressure, said post having a bore having an open mouth and tapering section.

2. The method of claim 1 wherein the tapering section terminates in a small diameter restricted portion.

* * * * *